US005610988A

United States Patent [19]

Miyahara

[11] Patent Number: 5,610,988

[45] Date of Patent: Mar. 11, 1997

[54] HEARING AID SET

[75] Inventor: Katsunobu Miyahara, Kanagawa, Japan

[73] Assignee: Sony Corporation, Japan

[21] Appl. No.: 662,287

[22] Filed: Jun. 12, 1996

Related U.S. Application Data

[63] Continuation of Ser. No. 293,184, Aug. 19, 1994, abandoned.

[30] Foreign Application Priority Data

Sep. 8, 1993 [JP] Japan ..... 5-246112

[51] Int. Cl.[6] ..... H04R 25/00

[52] U.S. Cl. ..... 381/68.4; 381/68; 381/69

[58] Field of Search ..... 381/68, 68.1, 68.2, 381/68.4, 68.6, 68.7, 69, 77; 73/585; 128/746; D24/174

[56] References Cited

U.S. PATENT DOCUMENTS

| | | | |
|---|---|---|---|
| 4,515,169 | 5/1985 | Ward | 128/746 |
| 4,783,813 | 11/1988 | Kempka | 381/67 |
| 4,790,019 | 12/1988 | Hueber | 381/68.4 |
| 4,918,736 | 4/1990 | Bordewijk | 381/79 |
| 5,012,520 | 4/1991 | Steeger | 381/68.6 |
| 5,167,236 | 12/1992 | Junker | 128/746 |
| 5,202,927 | 4/1993 | Tøpholm | 381/68 |
| 5,303,306 | 4/1994 | Brillhard | 381/68.4 |

FOREIGN PATENT DOCUMENTS

| | | | |
|---|---|---|---|
| 3642828 | 8/1987 | Germany | 381/68 |
| 57-65991 | 4/1982 | Japan . | |
| 61-35700 | 2/1986 | Japan . | |
| 4354300 | 12/1992 | Japan . | |
| 606297 | 1/1946 | United Kingdom | 381/68 |

*Primary Examiner*—Curtis Kuntz
*Assistant Examiner*—Xu Mei
*Attorney, Agent, or Firm*—Ronald P. Kananen

[57] ABSTRACT

A wireless hearing aid set consists of a hearing aid and a controller. The hearing aid comprises a microphone, a loudspeaker unit, a variable-gain circuit, a control circuit and a signal receiving unit. The microphone picks up ambient sound waves. The variable-gain circuits adjusts the frequency characteristics and the level of the output signals of the microphone. The loudspeaker unit receives the output signals of the variable-gain circuit and converts the output signals of the variable-gain circuit into corresponding sounds. The control circuit controls the variable-gain circuit on the basis of the output signals of the signal receiving unit. The controller comprises an operating unit and a transmission unit. The operating unit has a plurality of operating devices. The transmission unit transmits control signals corresponding input signals given thereto by operating the operating unit. The controller is provided with indicators for indicating set values, such as the gain of the variable-gain circuit and frequency characteristics of the output signals of the microphone.

2 Claims, 6 Drawing Sheets

HEARING AID SET

This application is a continuation of application Ser. No. 08/293,184 filed Aug. 19, 1994 abandoned.

BACKGROUND OF THE INVENTION

The present invention relates to a hearing aid and, more particularly, to a remotely controllable hearing aid.

Remotely controlled electronic apparatuses that are remotely controlled by a remote controller capable of transmitting infrared control signals or radiowave control signals have generally been known. Such a control system employing a remote controller is effectively applicable to the remote control of a hearing aid.

When an examiner, such as a doctor, determines an appropriate volume of sounds for the user of a hearing aid, the examiner examines the hearing acuity of the user, i.e., a hearing-impaired person, and calculates an appropriate volume level, i.e., a standard volume level, for a hearing aid to be used by the user on the basis of the results of the examination, makes the user put on the hearing aid, adjusts the volume of sounds generated by the hearing aid with reference to the calculated standard volume level, and determines a sound volume most agreeable to the user on the basis of the opinion of the user. If the hearing aid can be controlled by a remote controller, the examiner will be able to adjust the volume of sounds generated by the hearing aid very easily. However, even if the hearing aid can be controlled by the remote controller, the examiner operating the remote controller is unable to hear the sounds generated by the hearing aid and hence the sound volume controlling operation is dependent only on the opinion of the user. If the user of the hearing aid is an infant, who, in most cases, is incapable of accurately deciding a necessary sound volume, it is very difficult for the examiner to acquire accurate information for determining an appropriate sound volume and to adjust the sound volume to the necessary sound volume. A sound volume adjusting operation for adjusting the sound volume to a specified sound volume after temporarily changing the specified sound volume must be carried out only on the basis of the opinion of the user and the examiner is unable to know accurately if the sound volume has been adjusted to the specified sound volume.

Naturally, the hearing aid must be adjusted for frequency characteristics appropriate to the user and maximum output sound pressure level as well as for sound volume, and difficulties in adjusting the hearing aid for frequency characteristics and maximum output sound pressure level are the same as those in adjusting sound volume. Although the remote controller facilitates level adjusting operations, the examiner is unable to determine quantitatively the levels, such as maximum output sound pressure level and output sound pressure level at a specified frequency, and it is difficult for the examiner to decide if the levels has correctly been adjusted.

SUMMARY OF THE INVENTION

It is therefore an object of the present invention to provide a hearing aid set which solves the above-mentioned problems.

According to the present invention, there is provided a hearing aid set comprising: a hearing aid including a microphone, a variable-gain unit for varying the gain of the output signals of the microphone, a loudspeaker unit which receives the output signals of the variable-gain unit, a signal receiving unit, and a gain control unit which controls the gain of the variable-gain unit on the basis of control signals provided by the signal receiving unit; and a controller which transmits control signals to the signal receiving unit to control the hearing aid, including an operating unit to be operated to give input signals, and an output unit which provides control signals on the basis of input signals given thereto by operating the operating unit. The controller is provided with means for informing the operator of the gain of the variable-gain unit controlled by operating the operating unit.

According to the present invention, there is provided a hearing aid set comprising: a hearing aid including an electroacoustic transducer, an adjusting unit for adjusting the characteristics of sounds generated by the electroacoustic transducer, a receiving unit, and a control unit for controlling the adjusting unit on the basis of the output signals of the receiving unit; and a remote controller for remotely controlling the hearing aid, including an operating unit to be operated to give input signals, and a transmission unit which sends control signals corresponding to the input signals provided by the operating unit to the receiving unit. The remote controller is provided with a means for informing the operator of set values set by operating the adjusting unit by the operating unit.

According to the present invention, the operator of the controller or the remote controller is informed of set values including a set gain of the hearing aid determined by operating the operating unit of the controller or the remote controller. Accordingly, the operator is able to operate the controller or the remote controller with reference to information about set values including the sound volume, the frequency characteristics and the limit level of the hearing aid.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
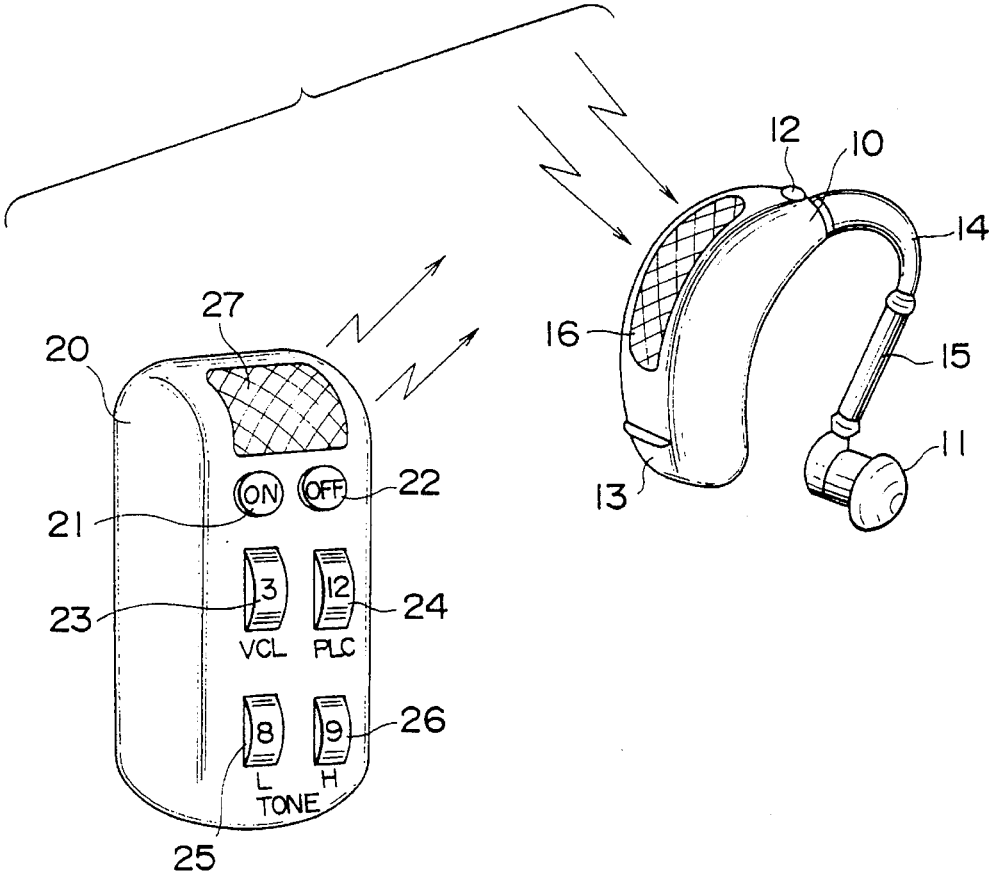
FIG. 1 is a perspective view of a hearing aid set in a first embodiment according to the present invention consisting of a hearing aid and a controller.

A hearing aid set in a first embodiment according to the present invention will be described hereinafter with reference to FIGS. 1 through 6. Referring to FIG. 1, the hearing aid set comprises a hearing aid 10 and a remote controller 20 for remotely controlling the gains of the components of the hearing aid 10. In the first embodiment, the remote controller 20 is capable of turning on and off power to the hearing aid 10, of adjusting sound volume, of adjusting the frequency characteristics, i.e., tone, of output sound and of adjusting maximum output level, i.e., limit level. The hearing aid 10 is formed in a shape substantially resembling the letter U so that the hearing aid 10 can be put on the external ear of the user. The hearing aid 10 has an ear hook 14, a tube 15 extending from the ear hook 14, and an earplug attached to the extremity of the tube 15. The hearing aid 10 is provided with a sound receiving grille 12, a battery compartment 13, and an infrared signal receiving unit 16 that receives infrared control signals from the remote controller 20. The hearing aid 10 is not provided with any one of a power switch, a volume adjusting knob, a tone adjusting knob, a limit level adjusting knob and such. However, the the hearing aid 10 may be provided with those knobs if necessary.

The remote controller 20 is provided with operating means including a power-on button 21, a power-off button 22, a volume adjusting dial 23, a limit level adjusting dial 24, a low-frequency tone adjusting dial 25 and a high-frequency tone adjusting dial 26, and an infrared control signal transmitter 27.

Figure 2:
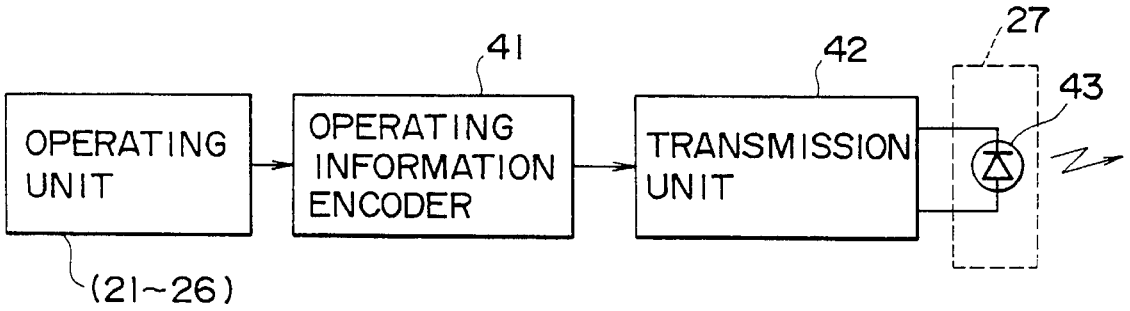
FIG. 2 is a block diagram of a control circuit included in the controller of the hearing aid set of FIG. 1.

Referring to FIG. 2 showing the electric circuit configuration of the remote controller 20, an operating information encoder 41 provides coded signals corresponding to operating data given by operating the operating means 21 to 26. The operating information encoder 41 may be, for example, a BCD code switch or a system that divides a reference voltage by a variable resistor and converts the divided voltage into a corresponding digital signal. If the operating means 21 to 26 are keys, the operating information encoder 41 may be a system that reads a command signal corresponding to a matrix specified by operating the key from an internal memory. The operating information encoder 41 may be any suitable system that provides coded signals according to the operation of the operating means. A transmission unit 42 receives a command signal from the operating information encoder 41, and modulates the frequency of a carrier by the command signal to provide a modulated control signal. A light-emitting diode 43 included in the infrared control signal transmitter 27 is turned on and off according to the modulated control signal to transmit an infrared command signal.

Figure 3:
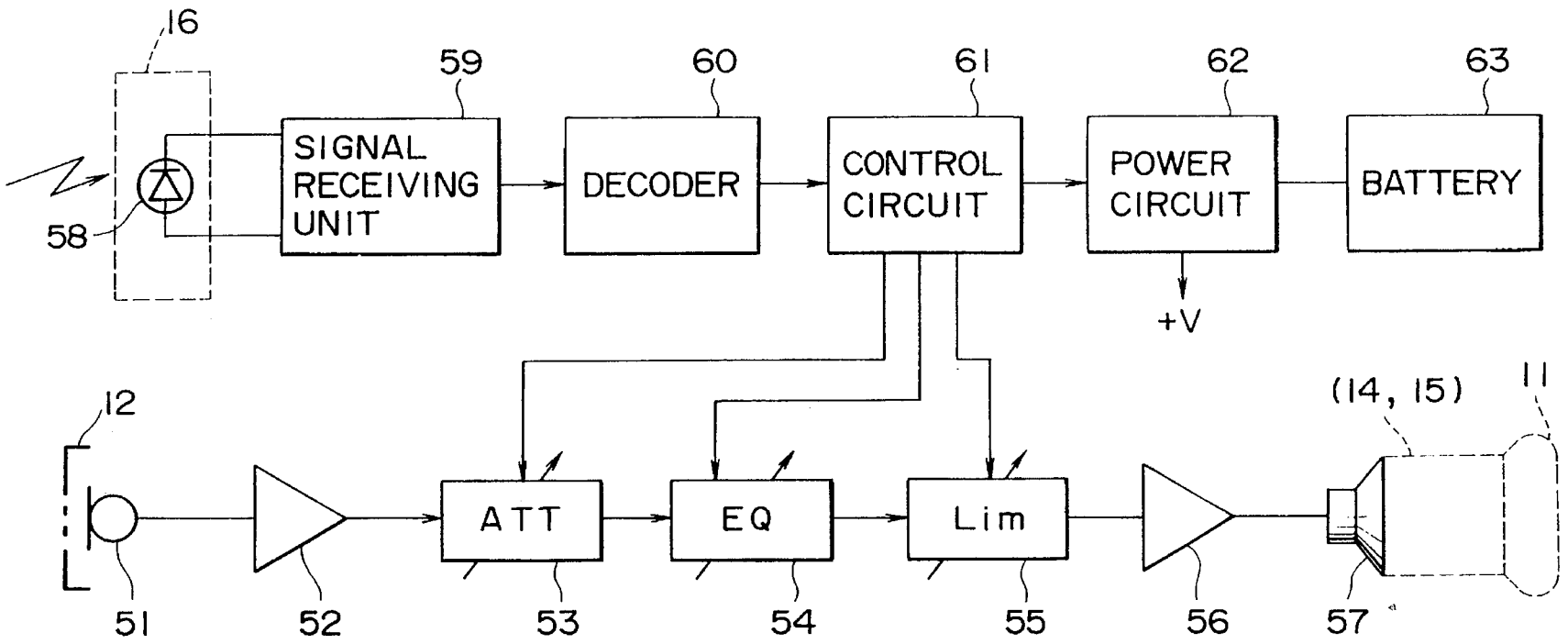
FIG. 3 is a block diagram of an electroacoustic circuit included in the hearing aid of the hearing aid set of FIG. 1.

Referring to FIG. 3 showing the electric circuit configuration of the hearing aid 10, a microphone 51 is disposed inside the sound receiving grille 12 to receive sound signals and to convert the sound signals into electric signals. The output electric signals are transferred through a preamplifier 52, an attenuator 53 and an equalizer 54 to a limiter 55. A main amplifier 56 amplifies the output signals of the limiter 55 and gives signals to a loudspeaker 57 to make the loudspeaker 57 generate sounds corresponding to the input electric signals. The sounds are transmitted through the ear hook 14 and the tube 15 to the earplug 11 to enable the user to hear the sounds.

Figure 4:
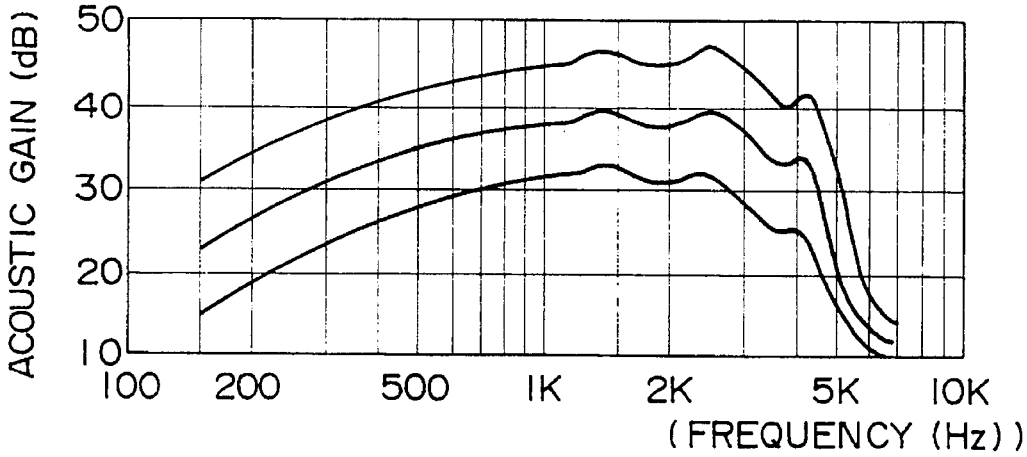
FIG. 4 is a graph showing the sound volume adjusting characteristics of an attenuator included in the hearing aid set of FIG. 1.
Figure 5A:
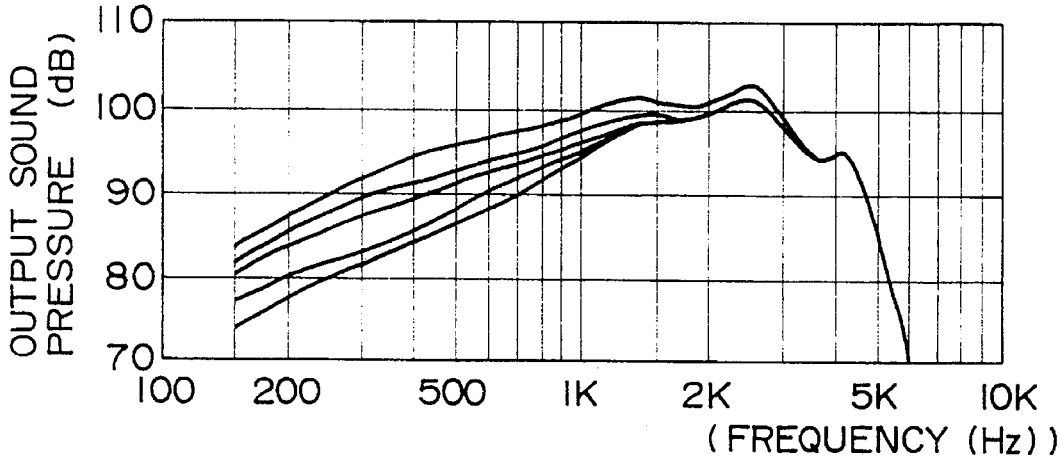
FIGS. 5(*a*) and 5(*b*) are graphs of assistance in explaining a procedure for adjusting the low-frequency characteristics and a procedure for adjusting the high-frequency characteristics, respectively, of an equalizer included in the hearing aid set of FIG. 1.
Figure 5B:
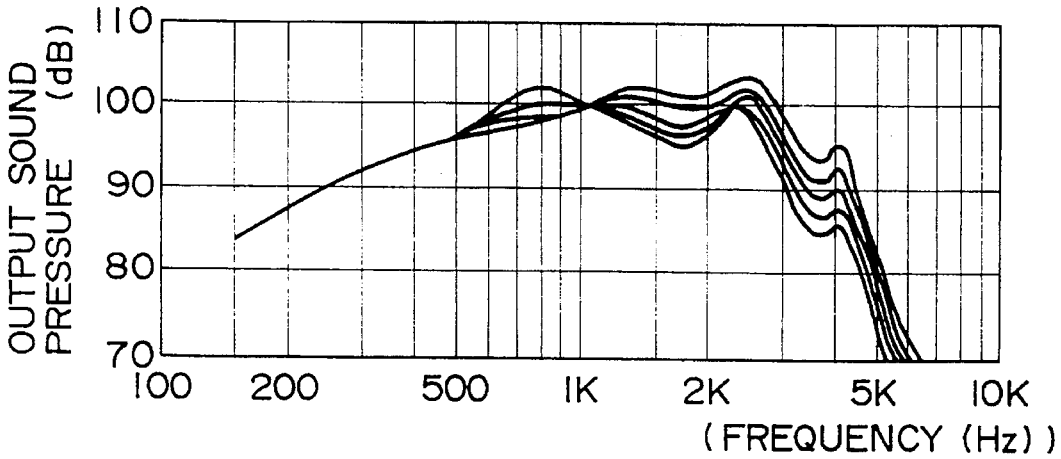

The respective gains of the attenuator 53, the equalizer 54 and the limiter 55 are variable. The attenuator 53 adjusts the level of the output signal of the preamplifier 52 or attenuates the output signal of the preamplifier 52. As shown in FIG. 4 by way of example, the attenuator 53 varies the acoustic gain of the output signal. The equalizer 54 varies the frequency characteristic of the sound pressure of output sound signals of the loudspeaker 57 as shown in FIG. 5(*a*) when the low-frequency range is adjusted. The equalizer 54 varies the frequency characteristic of the sound pressure of output sound signals of the loudspeaker 57 as shown in FIG. 5(*b*) when the high-frequency range is adjusted.

Figure 6:
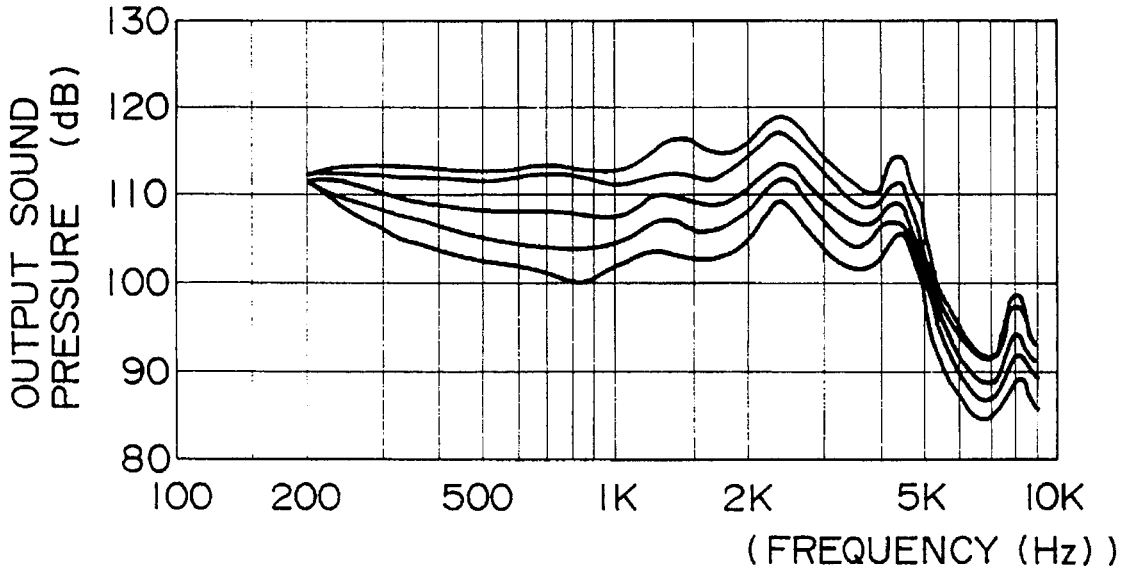
FIG. 6 is a graph of assistance in explaining a procedure for adjusting sound pressure level by a limiter included in the hearing aid set of FIG. 1.

The limiter 55 varies the maximum output sound pressure level of the output sound signals of the loudspeaker 57 as shown in FIG. 6. In FIG. 6, limiting quantity for the lower curves are greater than that for the upper curves.

The degree of adjustment of the output volume by the attenuator 53 is dependent on the degree of hearing impairment of the user, and the equalizer 54 is adjusted to adjust the sound pressure of the output of the loudspeaker 57, i.e., the frequency characteristic of sounds. Since some hearing-impaired people are less tolerant to large sound volumes than auditorily normal people, the limiting level of the limiter 55 is adjusted the sound volume is appropriate to the user.

The respective gains of those circuit components are changed according to command signals provided by the remote controller 20. Referring to FIG. 3, the infrared signal receiving unit 16 is provided with a photodiode 58, i.e., a light receiving element. The photodiode 58 receives an infrared signal and gives a corresponding electric signal to the receiving unit 59. The receiving unit 59 demodulates the output signal of the photodiode 58 to give a corresponding command code to the decoder 60. Then, the decoder 60 decodes the command code. The control unit 61 sends a control signal to the attenuator 53, the equalizer 54 or the limiter 55 according to the content of the command to change the sound volume, the frequency characteristic or the limiting level. When the volume adjusting dial 23 of the remote controller 20 is turned, the control unit 61 adjusts the gain of the attenuator 53 according to a command signal corresponding to a sound volume specified by operating the volume adjusting dial 23. When the limit level adjusting dial 24 is turned, the limit level of the limiter 55 for limiting the level of output sound pressure is adjusted according to a command signal corresponding to a limit level specified by operating the limit level adjusting dial 24. When either the tone adjusting dial 25 or 26 is turned, the control unit 61 adjusts the output sound frequency characteristic of the equalizer 54 according to a command signal corresponding to a tone specified by operating the tone adjusting dial 25 or 26. In FIG. 3, indicated at 62 is a power circuit and at 63 is a battery. The power-on button 21 and the power-off button of the remote controller 10 are operated to turn on and to turn off the power circuit 62, respectively.

As shown in FIG. 1, the volume adjusting dial 23 is marked with numerals representing the gain levels of the attenuator 53. In FIG. 1, the volume adjusting dial 23 is set at a position corresponding to a gain level "3" which corresponds to an acoustic gain of "30 dB" in FIG. 4. The limit level adjusting dial 24 is marked with, for example, numerals "8" to "12" respectively corresponding to 80 to 120 dB when the gain is variable, for example, in the range of 80 to 120 dB as shown in FIG. 6. The tone adjusting dial 26 is marked with, for example, numerals "7" to "11" respectively corresponding to 70 to 110 dB when the gain is variable in the range of, for example, 70 to 110 dB as shown in FIGS. 5(*a*) and 5(*b*).

As is obvious from FIGS. 4 to 6, the acoustic gain and the output sound pressure vary with frequency. The acoustic gain (sound volume) may be adjusted to a value (dB) corresponding to the average hearing threshold level or a value (dB) at a representative frequency. Tones may be adjusted to values corresponding to output sound pressures at the representative frequencies in the high-frequency range and the low-frequency range. The limit level may be adjusted to a value (dB) corresponding to an output sound pressure at a representative frequency.

The remote controller 20 facilitates the hearing aid adjusting operation of the examiner, i.e., a doctor, greatly. For example, the average hearing threshold level is calculated on the basis of the hearing test of the user and the sound volume of the hearing aid 10 is adjusted according to the calculated average hearing threshold level. The average hearing threshold level is calculated by dividing the sum of a hearing threshold level at 500 Hz, a value obtained by multiplying a hearing threshold level at 1000 Hz by two and a hearing threshold level at 2000 Hz by four. Suppose that the average hearing threshold level of the user is 60 dB. Then, a standard gain for the attenuator 53 is 30 dB and hence the examiner set the volume adjusting dial 23 of the remote controller 20 at "3" corresponding to 30 dB. On the contrary, when the volume adjusting dial 23 is set at "3" the examiner is able to find that the acoustic gain is set at 30 dB without asking user's opinion. The frequency characteristic and the limit level can be determined by the same procedure; that is, the frequency characteristic and the limit level of the hearing aid 10 can be adjusted on the basis of quantitative values obtained through hearing tests. Accordingly, even if the user is an infant who is unable to express the condition of the hearing aid 10 accurately, the examiner is able to adjust the hearing aid 10 properly on the basis of values obtained through hearing tests. Even if the setting of the hearing aid 10 is changed, the hearing aid 10 can easily be restored to the former setting, because the changes can be quantitatively known. Since the setting of the hearing aid 10 is adjusted by operating the remote controller 20 and the hearing aid 10 is not provided with any adjusting dial, the hearing aid 10 can be formed in a compact, lightweight construction suitable for continuous fitting on the ear.

FIGS. 7 to 10 illustrate remote controllers included in hearing aid sets in second to fifth embodiments according to the present invention. These remote controllers are intended to be used only for the control of the power source and the adjustment of sound volume.

Figure 7:
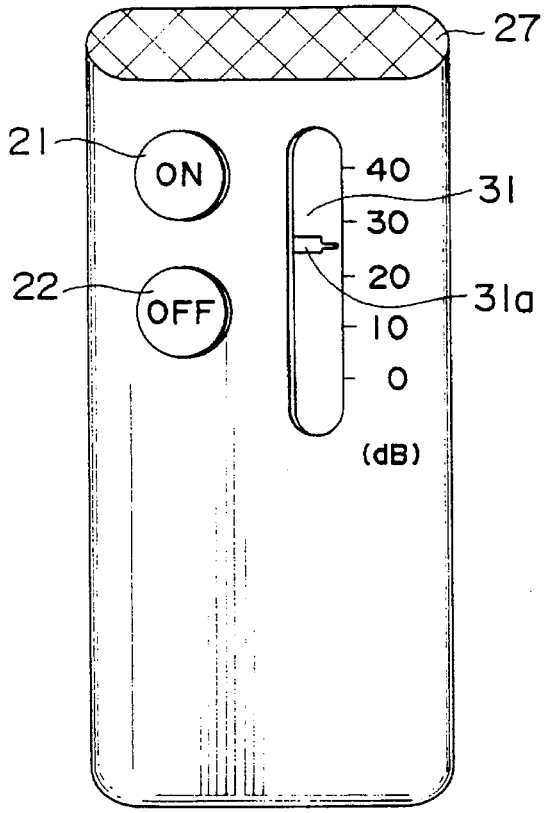
FIG. 7 is a perspective view of a controller included in a hearing aid set in a second embodiment according to the present invention.

Referring to FIG. 7 showing a remote controller included in a hearing aid set in a second embodiment according to the present invention, the remote controller is provided with a power-on button 21, a power-off button 22 and a sliding key type volume adjusting device 31 having a sliding key 31*a*. Numerals "0" to "40" respectively corresponding to 0 dB to 40 dB are marked on the case of the remote controller along a slot along which the sliding key 31*a* is moved. The sound volume of the hearing aid can be known quantitatively from the position of the sliding key 31a. Numerals "0" to "4" may be used instead of the numerals "0" to "40".

Figure 8:
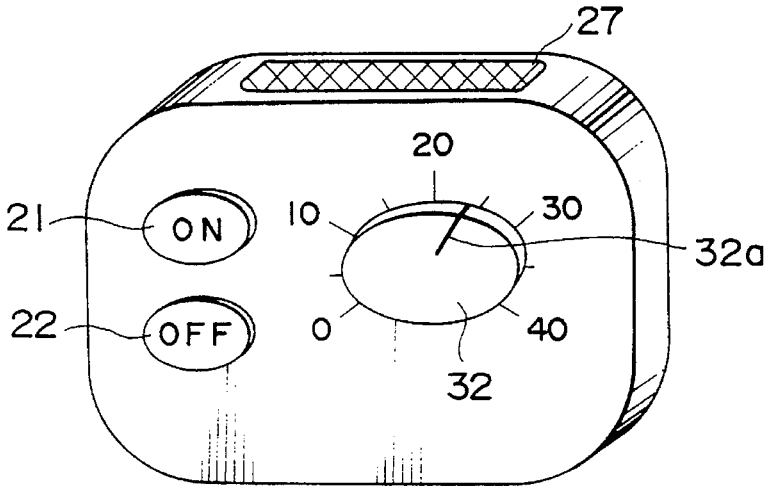
FIG. 8 is a perspective view of a controller included in a hearing aid set in a third embodiment according to the present invention.

Referring to FIG. 8 illustrating a remote controller included in a hearing aid set in a third embodiment according to the present invention, the remote controller is provided with a power-on button 21, a power-off button 22 and a dial type volume adjusting device 32 having a dial provided with an indicator mark 32a. Numerals "0" to "40" respectively representing 0 dB to 40 dB are marked around the dial on the case.

Figure 9:
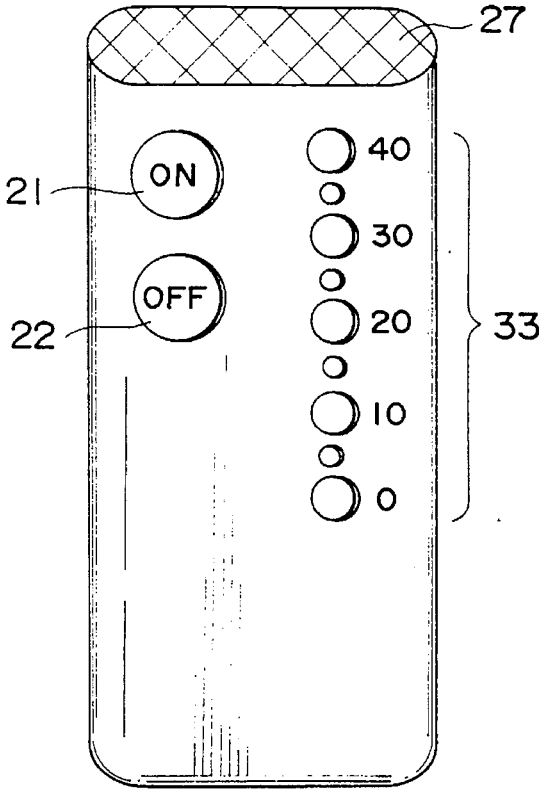
FIG. 9 is a perspective view of a controller included in a hearing aid set in a fourth embodiment according to the present invention.

Referring to FIG. 9 illustrating a remote controller included in a hearing aid set in a fourth embodiment according to the present invention, the remote controller is provided with a power-on button 21, a power-off button 22 and a touch switch type volume adjusting device 33 having switch buttons. Numerals "0" to "40" representing 0 dB to 40 dB are marked respectively beside the switch buttons.

Figure 10:
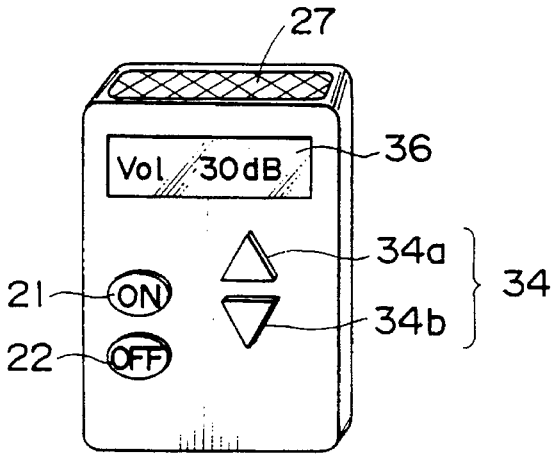
FIG. 10 is a perspective view of a controller included in a hearing aid set in a fifth embodiment according to the present invention.

Referring to FIG. 10 illustrating a remote controller included in a hearing aid set in a fifth embodiment according to the present invention, the remote controller is provided with a power-on button 21, a power-off button 22, a volume adjusting device 34 provided with a volume-up key 34*a* and a volume-down key 34*b*, and a display 36, such as a liquid crystal display, for indicating the acoustic gain of the hearing aid set by operating the volume-up key 34*a* or the volume-down key 34*b*.

The remote controllers shown in FIGS. 7 to 10 may be provided, in addition to the aforesaid functions, with functions for tone adjustment and limit level adjustment.

Although the invention has been described in its preferred embodiments, the present invention is not limited in its practical application to those embodiments specifically described herein. For example, a hearing aid in accordance with the present invention may be designed so as to be controlled by control signals other than the infrared control signals, such as radiowave control signals, ultrasonic control signals, or may be controlled by control signals transmitted thereto through a cable interconnecting the remote controller and the hearing aid. Naturally, the circuit configurations of the remote controller and the hearing aid may be other than those shown in FIGS. 2 and 3. Furthermore, mode of variation of acoustic characteristics including the maximum level may be other than those shown in FIGS. 4 to 6.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A hearing aid set comprising:

a hearing aid comprising:

a microphone for receiving sound signals and providing electric output signals representative thereof, variable-gain means for varying characteristics and level of the output signals from the microphone, a speaker unit that receives an output signal from the variable-gain means, receiving means for receiving control signals, and gain control means for varying the gain of the variable-gain means;

said variable gain means including a level adjusting unit, including an attenuator, for adjusting the level of the output signals from the microphone to be applied to the speaker unit; a frequency characteristic adjusting unit, including an equalizer, for adjusting the frequency characteristics of the output signals of the microphone to be applied to the speaker unit; and a sound volume adjusting unit, including a limiter, for adjusting the volume of sounds to be generated by the speaker unit, and a non-programmable controller for controlling the hearing aid, comprising:

operating means including at least one manually manipulable movable member for setting the gain of the variable gain means, wherein the operating means comprises a plurality of operating devices, and the indicating means comprise indicators that indicate that gain of the variable-gain means set by operating the operating devices of the operating means output means which outputs the control signals to the receiving means with input signals from the operating means, and analog type indicating means for visually indicating the gain of the variable-gain means specified by the input signals from the operating means, said indicating means comprising at least one fixed visible indicia which is associated with said at least one manually manipulable movable member and which visibly indicates a magnitude of at least one parameter which determines the gain of the variable gain means.

2. A hearing aid set according to claim 1, wherein the operating means comprises a plurality of operating devices, and the indicating means comprise a display that displays the gain of the variable-gain means set by operating the operating means.

* * * * *